US010919664B2

(12) United States Patent
Fields et al.

(10) Patent No.: US 10,919,664 B2
(45) Date of Patent: Feb. 16, 2021

(54) BEVERAGE CAN END HAVING AN ARCUATE PANEL WALL AND CURVED TRANSITION WALL

(71) Applicant: Crown Packaging Technology, Inc., Alsip, IL (US)

(72) Inventors: Brian Fields, Lemont, IL (US); Ezekiel Johnson, Brookfield, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 880 days.

(21) Appl. No.: 14/291,298

(22) Filed: May 30, 2014

(65) Prior Publication Data

US 2014/0353318 A1 Dec. 4, 2014

Related U.S. Application Data

(60) Provisional application No. 61/829,874, filed on May 31, 2013.

(51) Int. Cl.

| | |
|---|---|
| ***B65D 6/30*** | (2006.01) |
| ***B21D 51/26*** | (2006.01) |
| ***B65D 17/00*** | (2006.01) |

(52) U.S. Cl.

CPC ..... *B65D 7/36* (2013.01); *B21D 51/2661* (2013.01); *B65D 17/08* (2013.01); *B65D 2517/0062* (2013.01)

(58) Field of Classification Search

CPC ..... B65D 7/36
USPC ..... 220/623
See application file for complete search history.

(56) References Cited

U.S. PATENT DOCUMENTS

| | | | | |
|---|---|---|---|---|
| 4,641,761 | A * | 2/1987 | Smith et al. | 220/623 |
| 4,681,238 | A * | 7/1987 | Sanchez | 220/260 |
| 5,356,256 | A * | 10/1994 | Turner et al. | 413/8 |
| 5,911,551 | A | 6/1999 | Moran | |
| 5,971,259 | A * | 10/1999 | Bacon | 229/5.6 |
| 6,065,634 | A * | 5/2000 | Brifcani et al. | 220/619 |
| 6,419,110 | B1 * | 7/2002 | Stodd | 220/623 |
| 6,516,968 | B2 * | 2/2003 | Stodd | 220/623 |
| 6,561,004 | B1 * | 5/2003 | Neiner et al. | 72/715 |
| 7,100,789 | B2 * | 9/2006 | Nguyen et al. | 220/623 |
| 7,370,774 | B2 | 5/2008 | Watson et al. | |
| 7,591,392 | B2 * | 9/2009 | Watson et al. | 220/619 |
| 7,673,768 | B2 * | 3/2010 | Reed et al. | 220/619 |
| 7,938,290 | B2 * | 5/2011 | Bulso | 220/623 |
| 8,157,119 | B2 | 4/2012 | Watson et al. | |
| 8,313,004 | B2 * | 11/2012 | Stodd et al. | 220/619 |
| 8,328,041 | B2 * | 12/2012 | Brifcani et al. | 220/623 |
| 8,505,765 | B2 * | 8/2013 | Bulso | 220/623 |
| 8,727,169 | B2 * | 5/2014 | Nguyen | 220/315 |
| 2003/0010785 | A1 * | 1/2003 | Stodd | 220/623 |
| 2003/0121924 | A1 * | 7/2003 | Stodd | 220/608 |
| 2003/0173367 | A1 * | 9/2003 | Nguyen et al. | 220/669 |
| 2004/0074911 | A1 * | 4/2004 | Stodd | 220/619 |
| 2005/0006395 | A1 * | 1/2005 | Reed et al. | 220/619 |

(Continued)

FOREIGN PATENT DOCUMENTS

| | | |
|---|---|---|
| WO | WO 2012/039433 A1 | 3/2012 |
| WO | WO 2014/194058 A1 | 12/2014 |

*Primary Examiner* — Jeffrey R Allen
(74) *Attorney, Agent, or Firm* — BakerHostetler

(57) ABSTRACT

A beverage can end has an arcuate panel wall and a chuck wall having a curved transition wall portion. Configuration of the seaming panel and panel wall is provided.

33 Claims, 3 Drawing Sheets

(56) References Cited

U.S. PATENT DOCUMENTS

| | | | | |
|---|---|---|---|---|
| 2005/0029269 | A1* | 2/2005 | Stodd et al. | 220/619 |
| 2005/0252922 | A1* | 11/2005 | Reed et al. | 220/619 |
| 2006/0071005 | A1* | 4/2006 | Bulso | 220/619 |

* cited by examiner

BEVERAGE CAN END HAVING AN ARCUATE PANEL WALL AND CURVED TRANSITION WALL

CROSS-REFERENCE TO RELATED APPLICATIONS

This claims the benefit of U.S. Patent Application Ser. No. 61/829,874 filed May 31, 2013, the disclosure of which is hereby incorporated by reference as if set forth in its entirety herein.

BACKGROUND

This invention relates to a container technology, and more particularly to a can end for a beverage can and methods for seaming a beverage can end to a can body.

Modern beverage cans include a beverage can body that is drawn and ironed from aluminum stock and a beverage can end that is attached to the body by a double seam. The assignee of the present invention developed lightweight beverage ends, which are generally described in U.S. Pat. Nos. 8,328,041; 7,370,774; and 8,157,119. Some of the ends generally described in the patents are marketed under the trade name SuperEnd™.

Competitors have also developed lightweight ends that often incorporate features developed for SuperEnd. U.S. Pat. Nos. 7,673,768 and 8,313,004 disclose various lightweight ends, some of which have been commercialized Modern, lightweight beverage ends are rated to withstand internal can pressurization, as measured by a buckle performance test, often of 85 psi or more. Failure often includes loss of the circular profile and buckling of the end which, ultimately, leads to eversion of the end profile. Failure may be initiated by dropping or distorting the can end, or by overpressure within the container, such as when the can undergoes thermal processing or is subjected to high ambient temperature.

A version of a publically released, lightweight can end has been found to have problems with consistency of the seam dimensions upon double seaming to a beverage can.

SUMMARY

The inventors have developed a light weight beverage can end that they surmise overcomes the seaming problems referred to above, as well as other benefits. The inventors believe that a relationship between the seaming panel configuration, upper panel wall configuration, and a sufficient magnitude of reforming of the end's upper wall in the seamer alleviates the dimensional inconsistency in the seam. Accordingly, an end and corresponding method provide an end that is lightweight, can be used with a current, conventional chuck (or other conventional seaming technology), and is believed to provide for reliable and consistent seams. The present invention is not limited to these aspects, but rather encompasses other aspects of the end and combination of features disclosed in the description and stated in the claims.

A beverage can end capable of being seamed to a beverage can includes a center panel; an arcuate panel wall that extends outwardly from the center panel; an upwardly opening annular bead; a lower transition wall extending from an outer end of the annular bead, the lower transition wall being inclined at an angle A2 that is less than 11 degrees; a curved upper transition wall extending outwardly from an upper end of the lower transition wall, the lower transition wall yielding smoothly to the upper transition wall; a substantially flat intermediate wall; a substantially flat upper wall that is inclined more than the intermediate wall and that is inclined at an angle A4 that is at least 13 degrees; a juncture formed between the intermediate wall and the upper wall; a seaming panel extending from an upper end of the upper wall, the seaming panel having a radius R4 of between 0.050 inches and 0.060 inches; and a curl extending outwardly from an outer end of the seaming panel.

According to another aspect of the invention, a beverage can end comprises: a center panel; an arcuate panel wall that extends outwardly from the center panel, the panel wall having a maximum deviation D1 from a straight reference line by between 0.0008 (eight ten-thousandths) inches and 0.009 inches; an upwardly opening annular bead; a lower transition wall extending from an outer end of the annular bead, the lower transition wall being inclined at an angle A2 that is less than 11 degrees; a curved upper transition wall extending outwardly from an upper end of the lower transition wall, the lower transition wall yielding smoothly to the upper transition wall; a substantially flat intermediate wall; a substantially flat upper wall that is inclined more than the intermediate wall and that is inclined at an angle A4 that is at least 13 degrees; a juncture formed between the intermediate wall and the upper wall; a seaming panel extending from an upper end of the upper wall; and a curl extending outwardly from an outer end of the seaming panel. The end may be configured such that the seaming panel has a radius R4 of between 0.050 inches and 0.060 inches, and a curl extending outwardly from an outer end of the seaming panel.

Preferably dimension D1 is between 0.001 inches and 0.007 inches, more preferably between 0.001 inches and 0.005 inches, and in the preferred embodiment approximately 0.002 inches.

Preferably, angle A2 of the lower transition wall is between 1 degree and 10 degrees, more preferably between 2 degrees and 8 degrees, more preferably, between 3 degrees and 6 degrees, and, in the embodiment in the figures, about 5.5 degrees. Preferably, the intermediate wall is inclined at an angle A3 that is between 50 degrees and 63 degrees, more preferably between 52 degrees and 60 degrees, and, in a preferred embodiment, about 55 degrees. Preferably, the upper wall angle A4 is at least 13 degrees, more preferably at least 15 degrees, and, in the embodiment in the figures, approximately 16 degrees. Preferably, the panel wall is inclined at an angle A1 of between 30 degrees and 60 degrees, more preferably between 40 degrees and 50 degrees, and, in a preferred embodiment, about 45 degrees. The bead may be approximately symmetric about a vertical centerline.

The present invention encompasses an unseamed beverage end having the above characteristics and a combination of the unseamed beverage end and an unseamed beverage can body. The beverage can body prior to seaming includes a flange that matches the seaming panel shape and dimensions of the seaming panel radius. The seaming panel preferably has a radius R4 that is the sum of the radius R3 of the flange and the flange metal thickness t.

The present invention also encompasses a method for seaming a beverage can end and a beverage can body together, as well as the combination of the end and body after seaming. The method of seaming, which may be applied to an unseamed end of any configuration herein, includes placing the beverage can end on to a beverage can body, which has a flange that matches the seaming panel shape and dimensions of the seaming panel radius, and the seaming panel having a radius R4 that is the sum of the radius R3 of the flange and the flange metal thickness t. The method includes the step of bringing a chuck into engagement with an exterior surface of the end such that the chuck contacts the end and engaging the curl of the end with seaming rolls such that the upper wall is bent up by at least 9 degrees.

Preferably, the upper wall angle A4 is at least 13 degrees. More preferably, the upper wall angle A4 is at least 15 degrees and the upper wall is bent up by at least 11 degrees, and more preferably the upper wall angle A4 is approximately 16 degrees and the upper wall is bent up by at least 13 degrees. Where no upper range is expressly stated, a person familiar with end technology or seaming technology will understand that there is an upper practical limit of the parameter.

The disclosed beverage can end preferably is for double seaming by well-known seaming equipment and techniques onto a drawn and ironed beverage can body, such as a necked 211 sized can body. The end preferably is a 206, 204, or 200 size, and the inventors contemplate other sizes consistent with commercial beverage end industry.

DETAILED DESCRIPTION OF PREFERRED EMBODIMENTS

Figure 1:
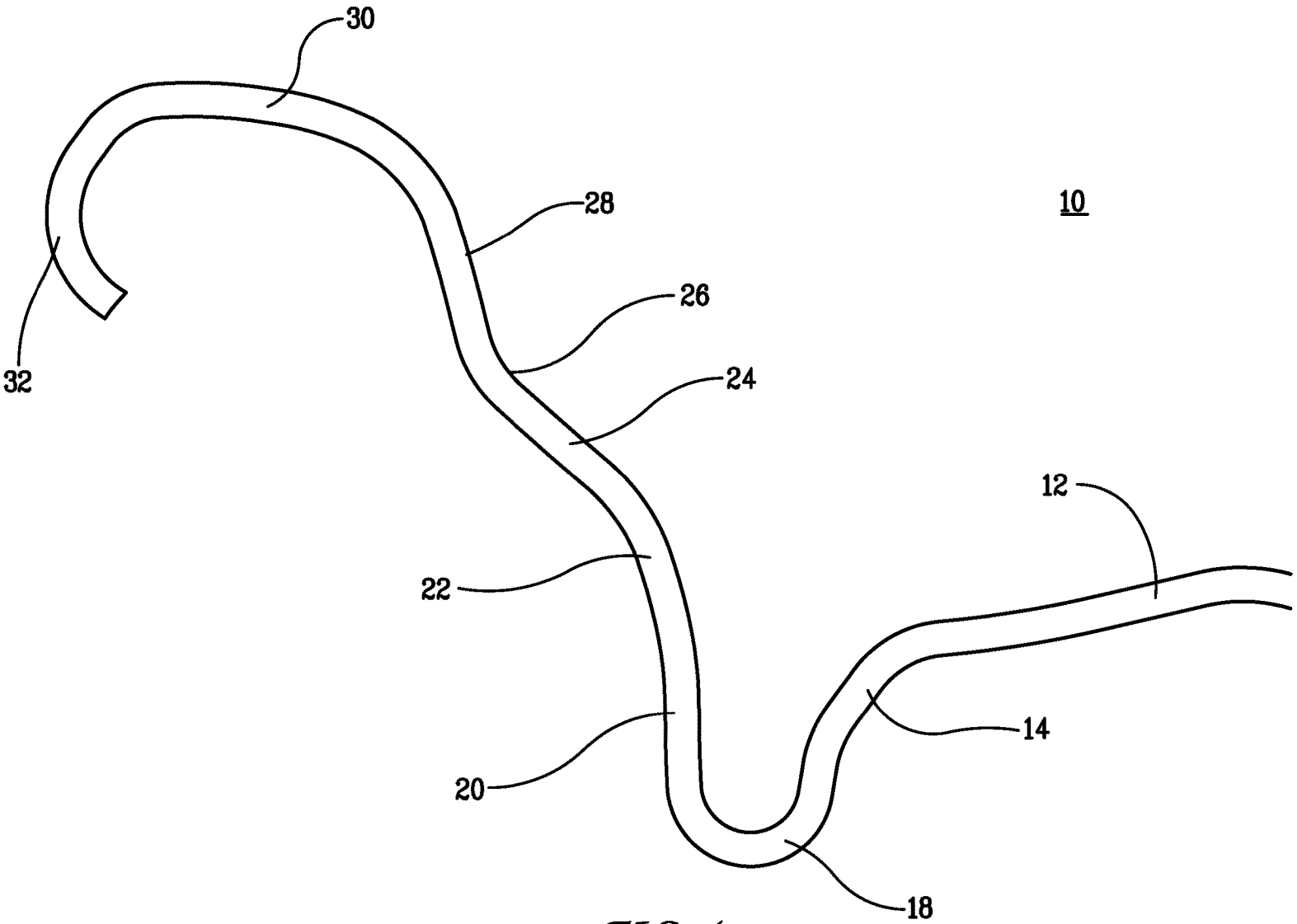
FIG. 1 is an enlarged cross sectional view of a portion of a beverage can end illustrating aspects of the present invention.

FIG. 1 illustrates a cross section of a beverage can end 10 illustrating aspects of the present invention. Can end 10 is a cross section of an end shell prepared by encasing a sample end in a polymer, cutting the shell into a cross section, and then photographing, enlarging, and enhancing the image. Accordingly, can end 10 is dimensionally accurate for a version of the end.

Can end 10 includes a center panel 12, a curved panel wall 14, a bead 18, a lower transition wall 20, a upper transition wall 22, a intermediate wall 24, a juncture 26, an upper wall 28, a seaming panel 30, and a curl 32.

Center panel 12 is circular and includes a pour opening and an opening mechanism, each of which preferably is conventional. For example, the pour opening may be formed by a score (not shown in the figures) in the shape known in the beverage end industry as a large opening end (LOE). The opening mechanism preferably is a convention stay-on-tab (SOT). Center panel 12 in the illustration of FIG. 1 is not flat because the cross section shows beading, as will be understood by persons familiar with can end center panels. The particular end shown in FIG. 1 is referred to as a DRT style.

The term "shell" is used in this disclosure to refer to the product of a shell press, including the finished profile. The term "end" is used to refer to the shell after a tab has been applied in a conversion press. Can end 10 is illustrated in its unseamed state, and the present invention encompasses a combination can body and end combination in the seamed state, the method for forming the combination, and the can body and end combination in which the unseamed end is positioned on the can body flange ready for seaming.

A curved panel wall 14 extends about center panel 12 such that in transverse cross section, as shown in FIG. 1, panel wall extends outwardly and downwardly from center panel 12. The terms "outwardly" and "inwardly" refer to a radial direction. The terms "upwardly" and "downwardly" refer to vertical direction as the end is conventionally oriented. The terms indicating radial direction and vertical direction are not exclusive. Nor do the terms indicate one is dominant over the other. For example, a part A that extends radially outwardly and from another part B and also extends upwardly from part B by a few degrees may be described in this disclosure and claims as extending outwardly, as extending upwardly, or as both extending upwardly and outwardly.

Figure 2:
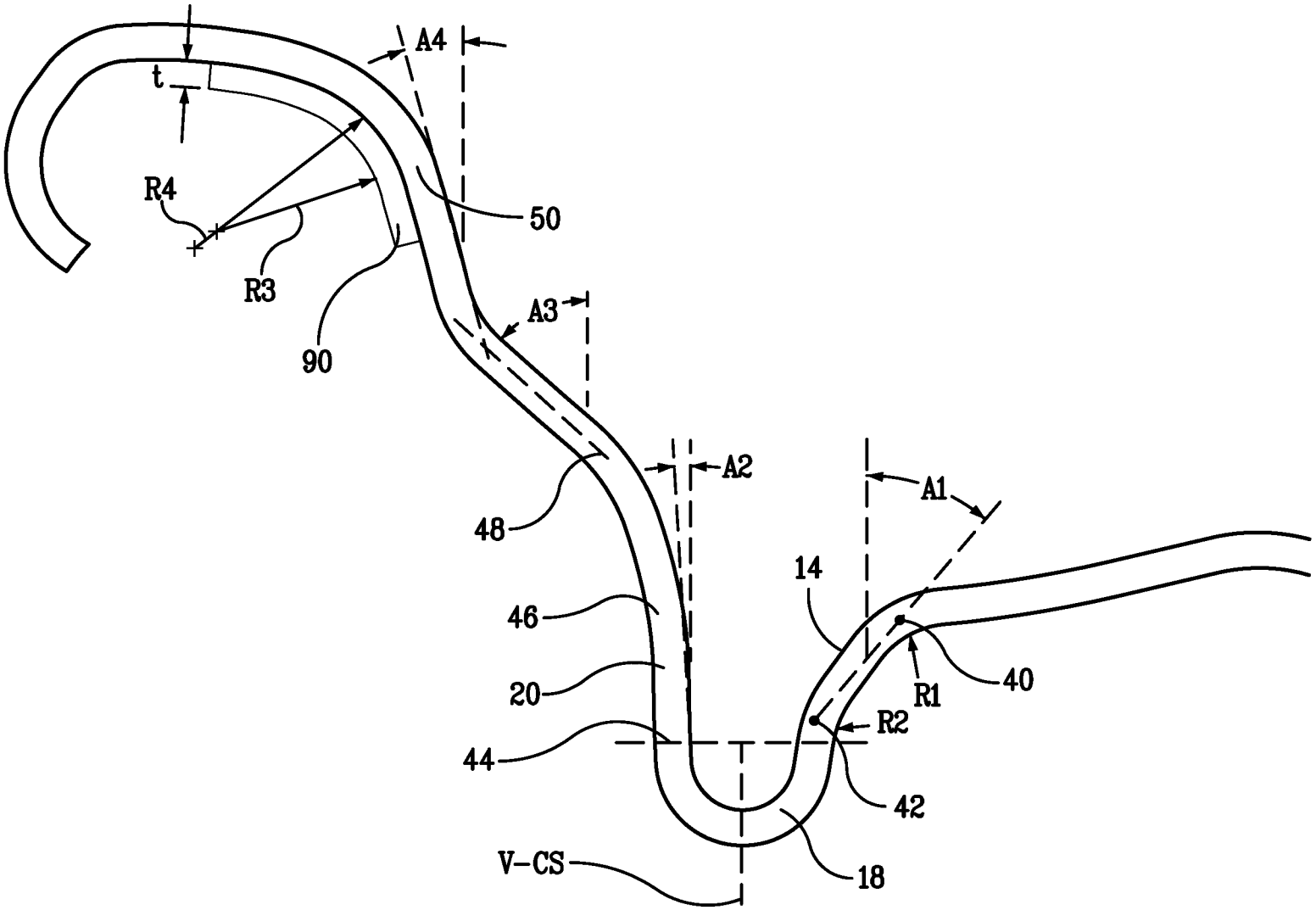
FIG. 2 is the cross sectional view of the end of FIG. 1 with additional annotation.

As illustrated in FIG. 2, even though panel wall 14 is curved, wall 14 may be defined by end points 40 and 42, which are on wall 14 where wall 14 merges with radii R1 and R2. Preferably, radii R1 and R2 are between 0.015 inches and 0.025 inches. The present invention is not limited to transitions at 40 and 42 that are formed by a single radius. For example, wall 14 may merge smoothly into center panel 12 and the inner bead wall of bead 18 or other configurations. In a configuration in which the transition at 40 and/or at 42 are not formed by a single radius, and there is no dominant radius that can be used as an approximation, points 40 and/or 42 may be identified by eye. A line drawn between end points 40 and 42 may be inclined at an angle A1 that is between 30 degrees and 60 degrees, preferably between 40 degrees and 50 degrees, and most preferably about 45 degrees.

Figure 3:
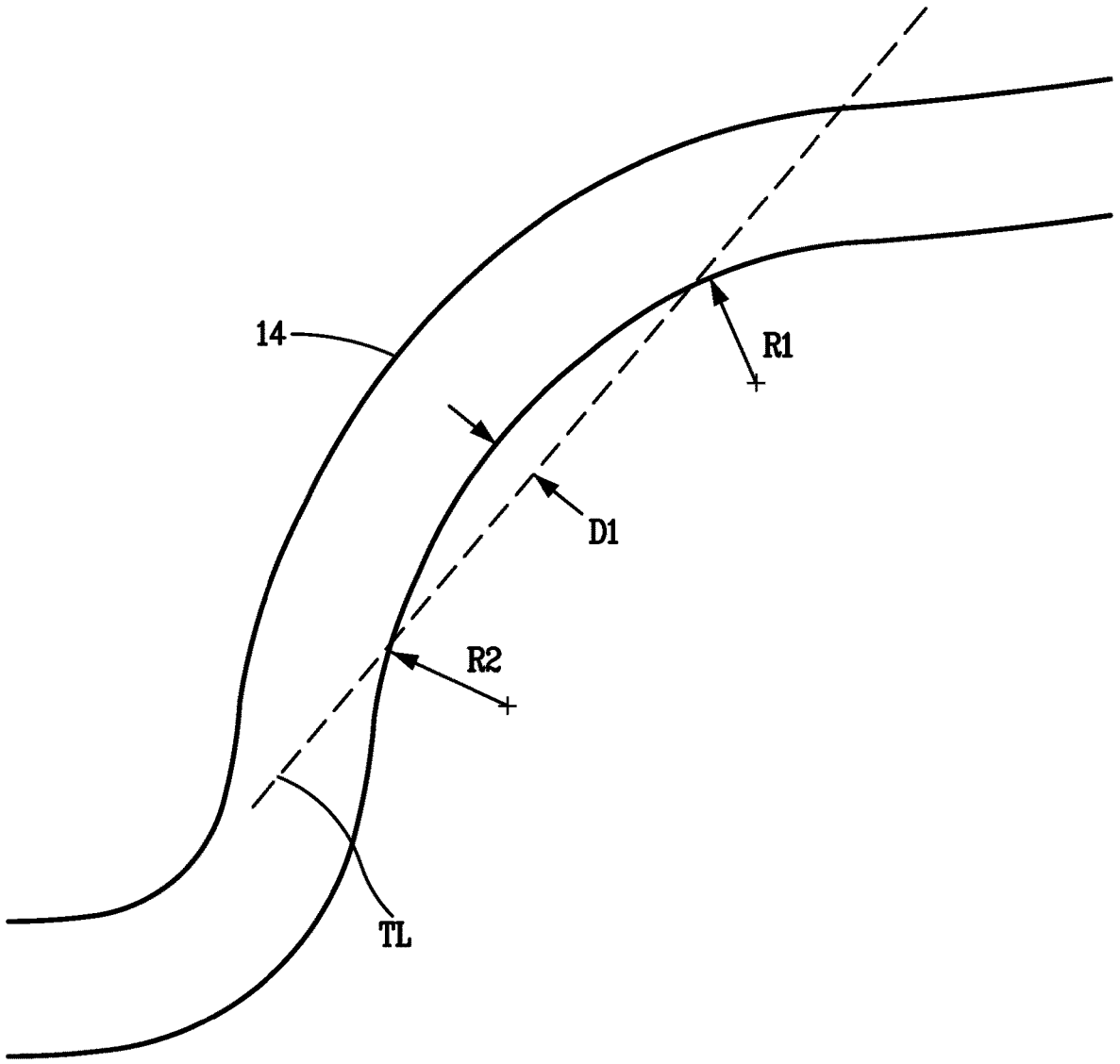
FIG. 3 is a further-enlarged cross sectional view of a portion of a beverage can end of FIG. 1.

Panel wall 14 may follow a single radius or may follow several radii in any combination. For defining the magnitude of the deviation of panel wall 14 from a straight line, FIG. 3 illustrates a dashed line TL that is tangent to a circle formed by radius R1 and a circle formed by radius R2. A maximum deviation distance D1 is defined as the distance between the tangent line TL and the inner surface of panel wall 14, measured perpendicular to tangent line TL at the point at which the inner surface of wall 14 is farthest from tangent line TL. Distance D1 preferably is greater than 0.001 inches, more preferably between 0.0008 inches (that is 0.8 thousandths or 8 ten-thousandths of an inch) and 0.009 inches, between 0.001 inches and 0.007 inches, and between 0.001 inches and 0.005 inches. In a preferred embodiment, distance D1 is approximately 0.002 inches. The inventors believe that the configuration of panel wall 14 provides for a combination of light weight and strength while diminishing the tendency of the end to leak upon failure, as will be understood by persons familiar with end failure mechanisms.

Annular countersink bead 18 preferably forms a semicircle and preferably is approximately symmetric (within ordinary manufacturing tolerances) about a vertical centerline V-CS. The horizontal dashed line in FIG. 2 defines the boundaries of the semi-circular shaped bead 18. The horizontal dashed line may be drawn horizontally from transition point 44 (defined below), from the point at which inner portion of the bead 18 yields to radius R2, or a point chosen such that bead 18 is symmetrical, as will be understood by persons familiar with end reinforcing bead configurations. The semi-circular shape of bead 18 is beneficial in embodiments in which a chuck (not shown in the figures) is positioned in the bead during the seaming process.

Lower transition wall 20 extends upwardly from an outer portion of bead 18. Preferably lower transition wall 20 is straight or nearly straight and is defined between transition points 44 and 46. A line between transition points 44 and 46 is inclined from vertical at an angle A2 that is less than 11 degrees, preferably less than 10 degrees, more preferably between 2 degrees and 8 degrees or between 3 degrees and 6 degrees, and in a preferred embodiment about 5.5 degrees.

A curved upper transition wall 22 extends from transition 46 to yield to a substantially flat intermediate wall portion 24. Intermediate wall portion 24 merges into upper wall portion 28 at juncture 26. Intermediate wall portion 24 preferably is substantially straight and inclined at a preferred angle A3 (FIG. 2) of between 50 degrees and 63 degrees, more preferably between 52 and 60 degrees, and in most preferably about 55 degrees.

Upper wall portion wall 28 is substantially straight above a transition portion at junction 26 such that a line between the end points of upper wall 28 is inclined at an angle A4 of at least 13 degrees, and more preferably at least 15 degrees. The upper limit of angle A4 is the practical limit on the bending required in the seamer. Because the angle of a conventional chuck is approximately 4 degrees, the magnitude of the angle of deformation during seaming can be calculated by subtracting 4 degrees from A4, such that the magnitude of deflection can be at least 9 degrees and more preferably at least 11 degrees.

Seaming panel 30 and curl 32 extend from transition 50. Seaming panel 30 has a radius R4. As shown in FIG. 2, a portion of a flange 90 of a can body is shown in a position in which end 10 is in position on flange 90 for seaming. The shape of seaming panel 30 matches the shape of flange 90—that is, there is no significant gap between the upper part of the highly curved flange 90 and the seaming panel 30. Further, the radius R4 of the seaming panel is the sum of the radius R3 of the flange and the flange metal thickness t. U.S. Pat. No. 5,911,511 (Moran), which is assigned to a predecessor of the assignee of the present invention, discloses aspects of the relationship between the seaming panel and the can body flange that are incorporated herein by reference, as will be understood by persons familiar with double seaming technology.

Curl 32 preferably is conventional and is chosen together with seaming roller configuration to achieve an industry suitable double seam at commercial line speeds.

Can end 10 is configured such that a seaming chuck (not shown in the figures) can extend into bead 18 to contact either the bottom radius of bead 18 and/or the outer wall of bead 18 and a lower portion of lower transition wall 20. Also the chuck will have a point at the lower end of its anvil portion that (optionally) may contact juncture 26. In any regard, upper wall 28 to is bent upwardly and inwardly during seaming.

The materials of the can end preferably is a 5000 series aluminum alloy or a tin plate steel and the materials of the can body preferably is a 3000 series aluminum alloy or a tin plate steel.

Aspects of the present invention and their advantages have been described, but the present invention is not limited to any aspect or advantage unless expressly set out in the claims.

We claim:

1. A beverage can end comprising:

a center panel;

an arcuate panel wall that extends outwardly from the center panel, the panel wall having a maximum deviation D1 from a straight reference line by between 0.0008 (eight ten-thousandths) inches and 0.009 inches; the straight reference line being drawn between and through (i) a juncture of the arcuate panel wall and the center panel and (ii) a juncture of the arcuate panel wall and the annular bead;

an upwardly opening annular bead;

a lower transition wall extending from an outer end of the annular bead, the lower transition wall being inclined at an angle A2 that is less than 11 degrees;

a curved upper transition wall extending outwardly from an upper end of the lower transition wall, the lower transition wall yielding smoothly to the upper transition wall;

a substantially flat intermediate wall;

a substantially flat upper wall that is inclined more than the intermediate wall and that is inclined at an angle A4 that is at least 13 degrees;

a juncture formed between the intermediate wall and the upper wall;

a seaming panel extending from an upper end of the upper wall, the seaming panel having a radius R4 of between 0.050 inches and 0.060 inches;

a curl extending outwardly from an outer end of the seaming panel.

2. The beverage can end of claim 1 wherein the angle A2 of the lower transition wall is between 1 degree and 10 degrees.

3. The beverage can end of claim 1 wherein the angle A2 of the lower transition wall is between 2 degrees and 8 degrees.

4. The beverage can end of claim 1 wherein the angle A2 of the lower transition wall is between 3 degrees and 6 degrees.

5. The beverage can end of claim 1 wherein the angle A2 of the lower transition wall is about 5.5 degrees.

6. The beverage can end of claim 1 wherein the intermediate wall is inclined at an angle A3 that is between 50 degrees and 63 degrees.

7. The beverage can end of claim 6 wherein the angle A3 of the intermediate wall is between 52 degrees and 60 degrees.

8. The beverage can end of claim 6 wherein the angle A3 of the intermediate wall is about 55 degrees.

9. The beverage can end of claim 1 wherein the upper wall angle A4 is at least 13 degrees.

10. The beverage can end of claim 1 wherein the upper wall angle A4 is at least 15 degrees.

11. The beverage can end of claim 1 wherein the upper wall angle A4 is approximately 16 degrees.

12. The beverage can end of claim 1 wherein the panel wall is inclined at an angle A1 of between 30 degrees and 60 degrees.

13. The beverage can end of claim 1 wherein the panel wall is inclined at an angle A1 of between 40 degrees and 50 degrees.

14. The beverage can end of claim 1 wherein the panel wall is inclined at an angle A1 of about 45 degrees.

15. The beverage can end of claim 1 wherein the bead is approximately symmetric about a vertical centerline.

16. A beverage can end and beverage can body combination comprising:

the beverage can end of claim 1; and a beverage can body; the beverage can body having a flange that matches the seaming panel shape and dimensions of the seaming panel radius, the seaming panel having a radius R4 that is the sum of the radius R3 of the flange and the flange metal thickness t.

17. A method for seaming a beverage can end and a beverage can body together, the method comprising:

placing the beverage can end of claim 1 on to a beverage can body; the beverage can body having a flange that matches the seaming panel shape and dimensions of the seaming panel radius, the seaming panel having a radius R4 that is the sum of the radius R3 of the flange and the flange metal thickness t;

bringing a chuck into engagement with an exterior surface of the end such that a lowermost point of an anvil of the chuck contacts the juncture of the end; and engaging the curl of the end with seaming rolls such that the upper wall is bent up by at least 9 degrees.

18. The method of claim 17 wherein the angle A2 of the lower transition wall is between 1 degree and 10 degrees.

19. The method of claim 17 wherein the angle A2 of the lower transition wall is between 2 degrees and 8 degrees.

20. The method of claim 17 wherein the angle A2 of the lower transition wall is between 3 degrees and 6 degrees.

21. The method of claim 17 wherein the angle A2 of the lower transition wall is about 5.5 degrees.

22. The method of claim 17 wherein the intermediate wall is inclined at an angle A3 that is between 50 degrees and 63 degrees.

23. The method of claim 22 wherein the angle A3 of the intermediate wall is between 52 degrees and 60 degrees.

24. The method of claim 22 wherein the angle A3 of the intermediate wall is about 55 degrees.

25. The method of claim 17 wherein the upper wall angle A4 is at least 13 degrees.

26. The method of claim 17 wherein the upper wall angle A4 is at least 15 degrees.

27. The method of claim 17 wherein the upper wall angle A4 is approximately 15 degrees.

28. The method of claim 26 wherein the upper wall is bent up by at least 11 degrees.

29. The method of claim 27 wherein the upper wall is bent up by at least 13 degrees.

30. The method of claim 17 wherein the panel wall is inclined at an angle A1 of between 30 degrees and 60 degrees.

31. The method of claim 17 wherein the panel wall is inclined at an angle A1 of between 40 degrees and 50 degrees.

32. The method of claim 17 wherein the panel wall is inclined at an angle A1 of about 45 degrees.

33. The method of claim 17 wherein the bead is approximately symmetric about a vertical centerline.

* * * * *